United States Patent [19]

Ishii

[11] 4,403,450

[45] Sep. 13, 1983

[54] WINDOW REGULATOR FOR AN AUTOMOTIVE VEHICLE

[75] Inventor: Kinichi Ishii, Yokohama, Japan

[73] Assignee: Kabushiki Kaisha Johnan Seisakusho, Japan

[21] Appl. No.: 412,992

[22] Filed: Aug. 30, 1982

[30] Foreign Application Priority Data

Sep. 2, 1981 [JP] Japan ..... 56-130418[U]

[51] Int. Cl.[3] ..... E05F 11/48

[52] U.S. Cl. ..... 49/352; 49/360

[58] Field of Search ..... 49/352, 360, 348

[56] References Cited

U.S. PATENT DOCUMENTS

| | | | |
|---|---|---|---|
| 1,503,500 | 8/1924 | Heintz | 49/352 X |
| 1,989,964 | 2/1935 | Beckler | 49/352 X |
| 2,555,859 | 6/1951 | Rappl et al. | 49/352 |

FOREIGN PATENT DOCUMENTS

| | | | |
|---|---|---|---|
| 1782896 | 5/1976 | Fed. Rep. of Germany . | |
| 1605975 | 4/1978 | Fed. Rep. of Germany | 49/352 |

*Primary Examiner*—Philip C. Kannan
*Attorney, Agent, or Firm*—McGlew and Tuttle

[57] ABSTRACT

A first and a second pulleys are rotatably supported at a fixed separation along a guide rail. A link arm is at one end pivotably connected to the axle of the first pulley and supports at the other end a drum which is rotatable manually or by an electric motor. A drive wire is fixed to the drum, sequentially wound around the first and second pulleys and finally secured to the drum. A window bracket, adapted to be secured to a window pane, is also secured to the wire so that rotation of the drum causes the wire and therefore the window pane to move along the guide rail. The regulator may include an additional pulley rotatably supported at a point opposite the first pulley with respect to the second pulley in which case, the drive wire is wound from the drum, around the first pulley, around the second pulley, around the additional pulley, around the first pulley again, and back to the drum. A device may be disposed near one of the second and additional pulleys to impart appropriate tension to the drive wire.

4 Claims, 6 Drawing Figures

WINDOW REGULATOR FOR AN AUTOMOTIVE VEHICLE

BACKGROUND OF THE INVENTION

The present invention relates to a window regulator for an automotive vehicle.

Window regulators for an automotive vehicle, using a drive wire, have been developed and used extensively.

Such a wire-type window regulator includes a wire extending parallel to the axis of desired movement of the window glass and wound around pulleys aligned along that axis normally vertical, both ends of the wire being wound around and fixed to a drum which can be rotated manually or by an electric motor. Rotation of the drum causes one end of the wire to be wound to the drum and the other end of the wire to be unwound from the drum so that the wire moves upwards or downwards along the axis of movement of the window glass, thereby moving the window pane secured to the wire.

Generally speaking, a guide unit which guides the window pane is installed separately from the handling unit which includes the handle. With the conventional regulator using a drive wire, this wire extends from the pulleys at the upper and lower ends of the guide unit to the drum and is wound around the drum.

As a whole, the drive wire defines a triangle so that the regulator occupies a relatively large area. In order to impart a predetermined tension to the wire and to maintain the regulator as an assembly in a fixed configuration, arm-shaped guide members fixed to upper and lower ends of the guide unit are provided to slidably support the wire between both upper and lower ends of the guide unit and the drum of the handling unit. These arm-shaped guide members fix the geometrical arrangement of the window regulator. Thus it can not be expected at all that such a regulator can be used in different cars.

Also, if the threaded holes in the guides unit and the handling unit of the regulator are not aligned with corresponding holes provided in the inner panel of the vehicle door due to manufacturing errors, the window regulator as it is can not be fixed to the inner panel.

It is an object of the present invention to eliminate the above drawbacks of the prior art.

SUMMARY OF THE INVENTION

The present invention provides a window regulator for an automotive vehicle which includes first and second pulleys supported at a fixed separation along a guide rail. One end of a link arm is pivotally connected to the axle of the first pulley and the other end thereof rotatably supports a drum. One end of a drive wire is connected to the drum, then wound around the first and second pulleys, again around the first pulley and is finally fixed to the drum. A window bracket is secured to the wire and is slidably mounted on the guide rail, the window bracket being securable to a window plane.

The window regulator may include an additional pulley rotatably supported by the guide rail at a point opposite the second pulley with respect to the first pulley in which case, the wire is wound from the drum, around the first pulley, around the second pulley, around the additional pulley, around the first pulley again, and back to the drum.

The window regulator may include a device which imparts appropriate tension to the wire.

One feature of the window regulator according to the present invention is that the pivotal link arm enables the drum and therefore the handle to assume any of a variety of positional relationships with respect to the guide rail.

Another feature of the present invention is that the window regulator can be reduced to a compact structure for storage and/or transportation.

Still another feature of the present invention is that the window regulator requires relatively little labor during assembly.

A further feature of the present invention is that even if the threaded holes in the guide unit and the handling unit of the regulator are not aligned with the corresponding holes provided in the inner panel of the vehicle, the window regulator can often be adjusted so as to be fixed to the inner panel.

DETAILED DESCRIPTION OF THE PREFERRED EMBODIMENTS

Figure 1:
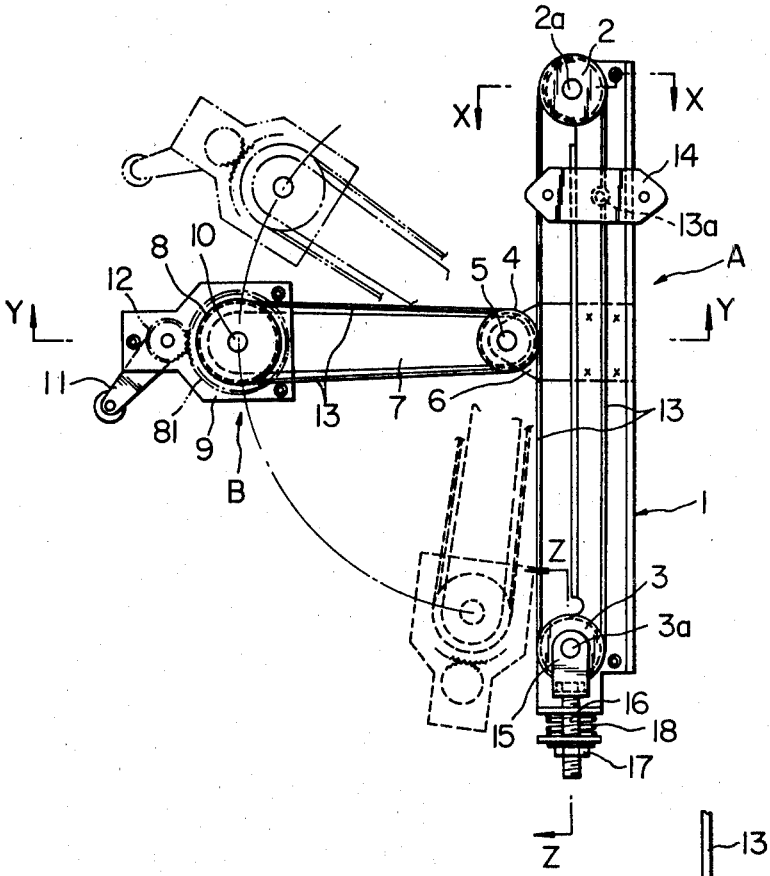
FIG. 1 is an elevation of a first preferred embodiment of a window regulator according to the present invention.
Figure 2:
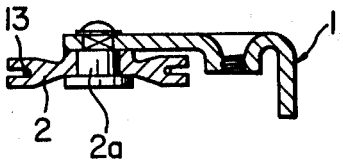
FIG. 2 is a cross-sectional view taken along line X—X of FIG. 1.

The present invention will be described with respect to the embodiment shown in the accompanying drawings.

In FIGS. 1–4, reference numeral 1 denotes a channel-like guide rail on the upper and lower ends of which are mounted pulleys 2 and 3. An intermediate pulley 4 is rotatably supported by a shaft 5 fixed to a point near the center of guide rail 1 via a bracket 6 secured to guide rail 1.

One end of a link arm 7 is pivotably connected independent of the pulley 4 to shaft 5 which also supports pulley 4 rotatably. A base plate 9 is mounted rotatably on a shaft 10 at the other end of link 7. A drum 8 is also rotatably supported by the shaft 10.

A pinion 12 which can be rotated by a handle 11 or an electric motor, not shown, is rotatably supported by base plate 9 so as to mesh with a gear 81 of drum 8.

Reference numeral 13 denotes a drive wire one end of which is fixed to and wound around drum 8, threaded around intermediate pulley 4, around lower pulley 3, around upper pulley 2, and again around intermediate pulley 4. The other end of wire 13 is then wound around the drum in the direction opposite to that of the first end of the wire 13.

A window bracket 14, secured to a lower portion of a window pane, not shown, is secured at a point 13*a* to wire 13 threaded between upper and lower pulleys 2 and 3 and is fitted over guide rail 1 so as to be movable vertically but not laterally.

Figure 4:
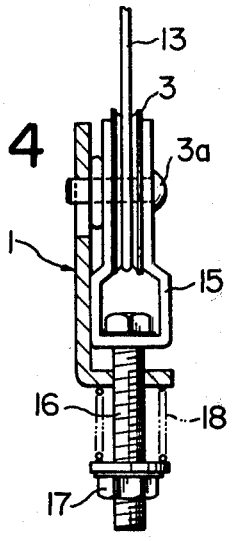
FIG. 4 is a cross sectional view taken along line Z—Z of FIG. 1.
Figure 3:
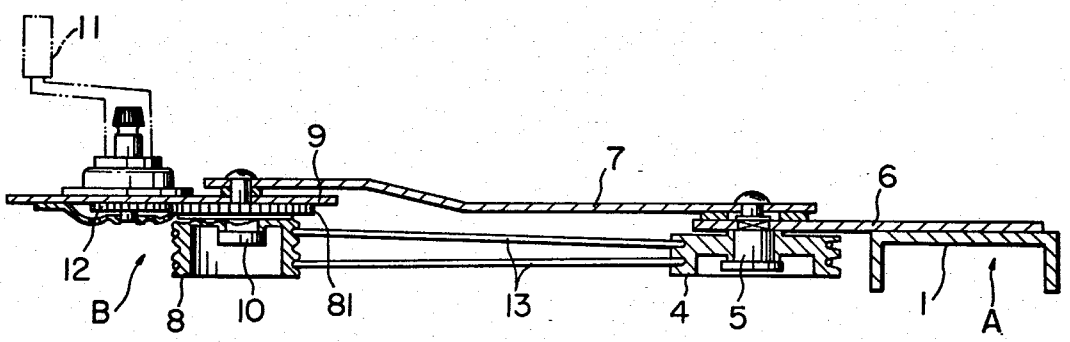
FIG. 3 is a cross-sectional view taken along line Y—Y of FIG. 1.

Lower pulley 3 is rotatably supported by a shaft 3*a* on a bracket 15, as shown best in FIG. 4, which is supported vertically adjustably on guide rail 1 by an adjustment mechanism which includes a bolt 16, a nut 17 threaded thereover and a spring 18 disposed between a lower flange of guide rail 1 and nut 17. Rotation of bolt 16 can impart appropriate tension to wire 13.

In the above arrangement, guide rail 1 and base plate 9 are fixed, for example, by screws, within the door of the automotive vehicle. Rotation of the drum by handle 11 or electric motor, not shown, causes drum 8 to rotate so that one end of wire 13 is wound onto drum 8 while the other end of wire 13 is unwound from drum 8. Window bracket 14, secured at 13*a* to wire 13, is guided downwards or upwards along guide rail 1 to cause the window pane to open or close the window.

According to the present invention, window glass guide unit A including guide rail 1, and upper, lower and intermediate pulleys 2, 3, 4, and handling unit B including handle 11, pinion 12 and drum 8 mounted on base plate 9 are connected by single pivotable link 7 so that the space occupied by the regulator according to the present invention can be folded so as to require less space when the regulator is to be transported or stored, than the prior art regulator wherein the wire is threaded from the upper and lower pulleys to the drum so as to form a fixed triangle. The present invention permits any desirable positional relationship between handling unit B and guide unit A within the range through which link 7 can pivot, as shown in dotted and chain lines in FIG. 1, so that it may be applicable to various vehicle models and styles.

Link arm 7 should be moved to the position, shown in broken line in FIG. 1, nearest the guide rail 1 during storage and transportation. It should be obvious that the present regulator is very easy to install within the door.

Figure 5:
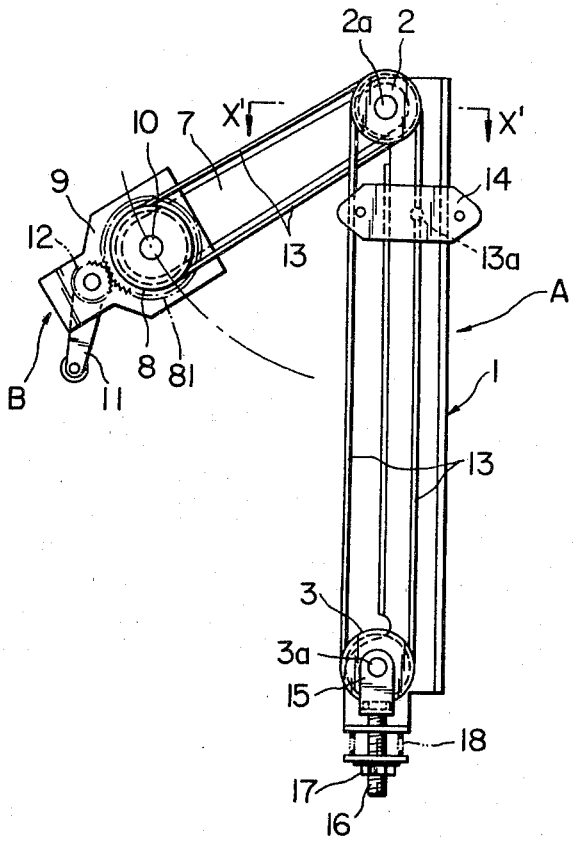
FIG. 5 is a view, similar to FIG. 1, of another embodiment of the present invention.
Figure 6:
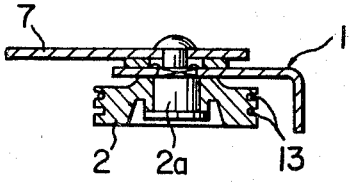
FIG. 6 is a cross-sectional view taken along line X'—X' of FIG. 5.

FIGS. 5 and 6 show another embodiment of the present invention wherein link 7 is pivotally connected to shaft 2*a* which independently supports upper pulley 2. One end of wire 13 is wound around drum 8, threaded around upper pulley 2, then around lower pulley 3, back around upper pulley 2, wound around drum 8 and secured to drum 8.

In this second embodiment, the positional relationship between window guide unit A and handling unit B can be selected freely within the range through which link 7 can pivot. Link 7 can be pivotted to lie nearly parallel to guide rail 1. Thus, this embodiment has not only the same functions and advantages as those of FIGS. 1–4 embodiment, but also eliminates the need for intermediate pulley 4 and bracket 6, such as shown in FIGS. 1–4, thereby reducing the number of parts and the weight of the regulator.

The other elements of this embodiment are the same as in FIGS. 1 to 4 and the same reference numerals as those in FIGS. 1 to 4 denote similar parts.

In FIGS. 1–6, a balancing spring, not shown, to balance the weight of the window pane may be included with drum 8 or members rotated by the rotation of drum 8. The position and the structure of the balancing spring can be selected optionally without affecting the function of the present invention.

While the present invention has been described and shown in two embodiments thereof, it should be noted that the present invention is not limited to these. For example, pinion 12 may be removed in which case, handle 11 is arranged to be fitted over shaft 10. Alternatively electric motor may be connected to shaft 10 to drive drum 8. Various change and modifications could be made by those skilled in the art without departing from the spirit and scope of the invention set forth in the attached claims.

What is claimed is:

1. A window regulator for an automotive vehicle comprising:

(a) a guide rail;

(b) first and second pulleys rotatably supported in a fixed spatial relationship along the guide rail;

(c) a link arm, one end of which is pivotably connected to the axle of the first pulley;

(d) a drum rotatably supported by the other end of the link arm;

(e) a drive wire, one end of which is fixed to the drum, then wound sequentially around the first pulley, around the second pulley, then around the first pulley again, and the other end of which is fixed to the drum, the opposite ends of the drive wires being wound around the drum in opposite directions; and (f) a window bracket secured to the wire and slidably mounted on the guide rail, the window bracket being securable to a window pane.

2. The window regulator as claimed in claim 1, further including an additional pulley rotatably supported by the guide rail at a point opposite the second pulley with respect to the first pulley, and wherein the wire is wound from the drum around the first pulley, around the second pulley, around the additional pulley, around the first pulley again, and back to the drum.

3. The window regulator as claimed in claim 1 or 2, further including means for imparting appropriate tension to the wire.

4. The window regulator as claimed in claim 3, wherein the imparting means is disposed near one of the pulleys.

* * * * *